US008040282B2

(12) United States Patent
Tsubono et al.

(10) Patent No.: US 8,040,282 B2
(45) Date of Patent: Oct. 18, 2011

(54) CARD-TYPE DEVICE

(75) Inventors: Masanori Tsubono, Machida (JP); Wataru Kakinoki, Nagaokakyo (JP)

(73) Assignees: Murata Manufacturing Co., Ltd., Nagaokakyo-shi, Kyoto-fu (JP); SII Mobile Communications, Inc., Mihama-ku, Chiba-shi (CN)

( * ) Notice: Subject to any disclaimer, the term of this patent is extended or adjusted under 35 U.S.C. 154(b) by 572 days.

(21) Appl. No.: 12/119,687

(22) Filed: May 13, 2008

(65) Prior Publication Data

US 2008/0211723 A1 Sep. 4, 2008

(30) Foreign Application Priority Data

Nov. 16, 2005 (JP) ..... 2005-331862
Mar. 8, 2006 (JP) ..... 2006-062743
Nov. 15, 2006 (WO) ..... PCT/JP2006/322758

(51) Int. Cl.
*H01Q 1/24* (2006.01)

(52) U.S. Cl. ..... 343/702; 343/872

(58) Field of Classification Search ..... 343/702, 343/906, 872

See application file for complete search history.

(56) References Cited

U.S. PATENT DOCUMENTS 5,361,061 A 11/1994 Mays et al.
5,617,106 A * 4/1997 Tahmassebpur ..... 343/702
6,031,497 A * 2/2000 Nam ..... 343/702
6,708,046 B1 3/2004 Takagi
2001/0019946 A1 9/2001 Okuda
2002/0163472 A1 11/2002 Kasuya et al.

FOREIGN PATENT DOCUMENTS

| | | |
|---|---|---|
| JP | 06-021846 | 1/1994 |
| JP | 8-502633 | 3/1996 |
| JP | 2001-069029 | 3/2001 |
| JP | 2001-165144 | 6/2001 |
| JP | 2001-243435 | 9/2001 |
| JP | 2001-251399 | 9/2001 |
| JP | 2002-077338 | 3/2002 |
| JP | 2003-22151 | 1/2003 |
| JP | 2003-188619 | 7/2003 |

OTHER PUBLICATIONS

PCT/JP2006/322758 dated Mar. 6, 2007 International Search Report.
PCT/JP2006/322758 dated Mar. 6, 2007 Written Opinion.
Japanese Office Action dated Aug. 31, 2010 (for Japanese Patent Application No. 2007-545265) and English translation of same.

* cited by examiner

*Primary Examiner* — Dieu H. Duong
(74) *Attorney, Agent, or Firm* — Dickstein Shapiro LLP

(57) ABSTRACT

A card-type device that includes an antenna body disposed on a housing and movable along a turning shaft between an upright position and a flat position. An antenna turning member applies an urging force to the antenna body in a direction in which the antenna body turns to the upright position. A locking projection projecting and a corresponding locking portion which is fitted to the locking projection when the antenna body is in the flat position, stops the antenna body from turning. When the antenna body moves in a direction in which the antenna body is to be unlocked, the locking projection is released from the locking portion, and the antenna body automatically turns toward the upright position by the urging force of the antenna turning member.

6 Claims, 11 Drawing Sheets

CARD-TYPE DEVICE

CROSS REFERENCE TO RELATED APPLICATIONS

The present application is a continuation of International Application No. PCT/JP2006/322758, filed Nov. 15, 2006, which claims priority to Japanese Patent Application No. JP2005-331862, filed Nov. 16, 2005, and Japanese Patent Application No. JP2006-062743, filed Mar. 8, 2006, the entire contents of each of these applications being incorporated herein by reference in their entirety.

FIELD OF THE INVENTION

The present invention relates to a card-type device such as a PC card having a wireless communication function.

BACKGROUND OF THE INVENTION

FIG. 12 shows a perspective view schematically illustrating an embodiment of a card-type device (refer to Patent Document 1, for example). A card-type device 40 has a wireless communication function, and includes a circuit board 41, a flat housing 42 which accommodates the circuit board 41, and an antenna structure body 43 which is disposed outside of the housing 42 and which performs wireless communication utilizing radio waves. The antenna structure body 43 includes an antenna turning shaft 44 at a base end thereof, and the antenna turning shaft 44 projects from the antenna structure body 43. The housing 42 has a through-hole on one side which allows the antenna turning shaft 44 to be inserted into the housing 42. The housing 42 also has inside thereof a bearing (not shown) which receives the antenna turning shaft 44. With this configuration of the card-type device 40, the antenna structure body 43 turns on the antenna turning shaft 44, and the shaft 44 acts as the axis of turn. For example, when the card-type device 40 is used by being inserted into a card slot of an information terminal apparatus such as a personal computer, the antenna structure body 43 is turned so as to stand on an upper surface of the housing 42 as shown by a dashed line in FIG. 12. Thereby, the sensitivity to radio waves for transmission/reception is enhanced. On the other hand, when the card-type device 40 is detached from the card slot of the information terminal apparatus and is carried about, the antenna structure body 43 is turned into an accommodated flat position to be laid flat as shown by a solid line in FIG. 12. Thus, the card-type device 40 is readily carried.

Patent Document 1: Japanese Unexamined Patent Application Publication No. 2001-69029

Patent Document 2: Japanese Unexamined Patent Application Publication No. 2001-243435

Patent Document 3: Japanese Unexamined Patent Application Publication No. 6-21846

In the configuration of the card-type device 40 shown in FIG. 12, in order to turn the antenna structure body 43 from the flat position to the upright position, the antenna structure body 43 is turned upward manually, for example, drawn up using a nail. The manual operation of turning the antenna structure body 43 upright is troublesome, and therefore, the device 40 is not user-friendly.

SUMMARY OF THE INVENTION

In order to solve the problem above, the present invention provides the following structure. Specifically, the present invention provides a card-type device which has a wireless 3 communication function and which has a circuit board accommodated in a flat housing. The card-type device includes an antenna structure body which is disposed outside of the housing and which is used to perform wireless communication utilizing radio waves, a turning center shaft which is used to turn the antenna structure body within an operation range between an upright position in which the antenna structure body stands on an upper surface of the housing and a flat position in which the antenna structure body is laid flat, and an antenna turning elastic member which applies an urging force to the antenna structure body in a direction in which the antenna structure body turns toward the upright position on the turning center shaft. The antenna structure body is disposed on the housing through the turning center shaft so as to be movable along the turning center shaft within an allowable movement range. One of the antenna structure body and the housing has a locking projection projecting toward the other, and the other of the antenna structure body and the housing has a locking portion which is to be fitted to the locking projection when the antenna structure body is laid flat and which stops the antenna structure body from turning in a direction toward the upright position due to the urging force applied by the antenna turning elastic member. The locking projection and the locking portion form a locking mechanism of the antenna structure body. In a state in which the locking projection is fitted to the locking portion, when the antenna structure body entirely moves along the turning center shaft in an unlocking direction, the locking projection is released from the locking portion, and the antenna structure body turns in the direction toward the upright position.

According to the present invention, the card-type device includes an antenna turning elastic member which applies an urging force to the antenna structure body in a direction in which the antenna structure body turns toward the upright position on the turning center shaft. Accordingly, the antenna structure body automatically turns from the flat position to the upright position to stand on the upper surface of the housing. Consequently, the antenna structure body readily turns to stand without a complicated operation, and usability of the card-type device is improved.

Furthermore, according to the present invention, the antenna structure body turns to the upright position utilizing the urging force of the antenna turning elastic member, that is, by using elastic energy of the antenna turning elastic member, and therefore electric energy is not used. Accordingly, an increase in power consumption of the card-type device is prevented. Moreover, since the mechanism utilizing the antenna turning elastic member to turn the antenna structure body to the upright position can be of a simple structure, a configuration of the card-type device is prevented from being complicated, and the card-type device which is difficult to be broken down and which has long life is obtained.

In addition, in the related art, a card-type device having an incorporated antenna which is, for example, surface-mounted on a circuit board in a housing, instead of an antenna disposed outside a housing, has been proposed. In the conventional card-type device, however, since the incorporated antenna is accommodated in the housing, sensitivity to radio waves for wireless communication is likely to be low. To solve this problem, in the present invention, the antenna structure body is disposed outside the housing, and the antenna structure body is configured to be capable of standing on the upper surface of the housing. Therefore, sensitivity of the antenna structure body to radio waves for wireless communication is readily enhanced.

Furthermore, according to the card-type device of the present invention, one of the antenna structure body and the housing has a locking projection projecting toward the other, and the other of the antenna structure body and the housing has a locking portion which is to be fitted to the locking projection when the antenna structure body is laid flat. Since the locking projection is locked in the locking portion, a turning motion of the antenna structure body due to the urging force of the antenna turning elastic member is stopped, and the state in which the antenna structure body is laid flat is maintained. Furthermore, according to the embodiment, the antenna structure body is disposed on the housing through the turning center shaft so as to be movable along the turning center shaft within an allowable movement range. Moreover, a locking state in which the locking projection is fitted to the locking portion is cancelled by moving the entire antenna structure body along the turning center shaft in an unlocking direction, and the antenna structure body automatically stands up utilizing the urging force of the antenna turning elastic member. That is, the locking state of the locking projection and the locking portion is cancelled merely by moving the entire antenna structure body to the unlocking direction. Accordingly, it is not necessary to provide an operating unit such as an unlock button for cancelling the locking state of the locking projection and the locking portion. Consequently, a complicated mechanism to cancel the locking state of the locking projection and the locking portion is not necessary. That is, a complicated configuration of the card-type device can be avoided.

The locking state to stop the antenna structure body from turning toward the upright position can be cancelled merely by moving the entire antenna structure body in an unlocking direction, and thus, operation for cancelling the locking state is very simple. Furthermore, development of small and thin card-type devices has been advanced. Therefore, if an operating unit for cancelling the locking state of the antenna structure body, such as a button, is provided in such a small and thin card-type device, an extremely small operating unit for cancelling the locking state should be prepared, and such an operating unit is difficult to operate. However, the antenna structure body is larger than the operating unit for cancelling the locking state, and according to the present invention, only by moving the larger antenna structure body entirely in the unlocking direction, the locking state of the antenna structure body is cancelled, thereby never causing a problem that it is difficult to cancel the locking state of the antenna structure body and never deteriorating the usability.

REFERENCE NUMERALS

Figure 1A:
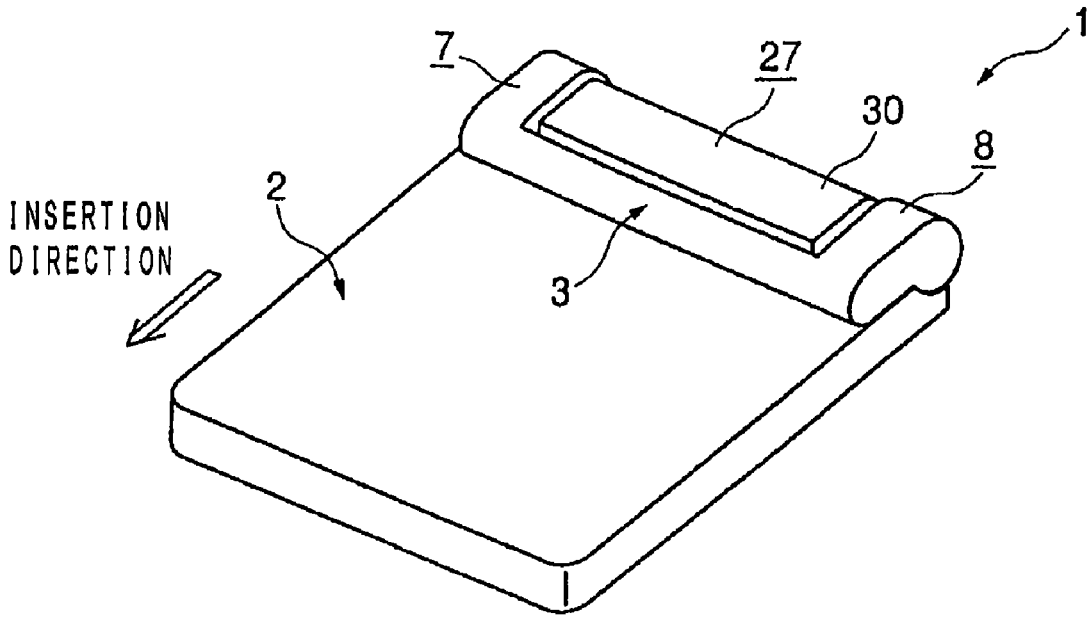
FIG. 1*a* is a perspective view schematically illustrating a card-type device according to a first embodiment.

1 card-type device
2 housing
3 antenna structure body
19, 47 turning shaft
25, 48 turning spring
31 spring
32 recess
33 locking projection
34 locking projection
35 locking portion
36 recess
46 turning mechanism unit
51 unit case

DETAILED DESCRIPTION OF THE INVENTION

Figure 1B:
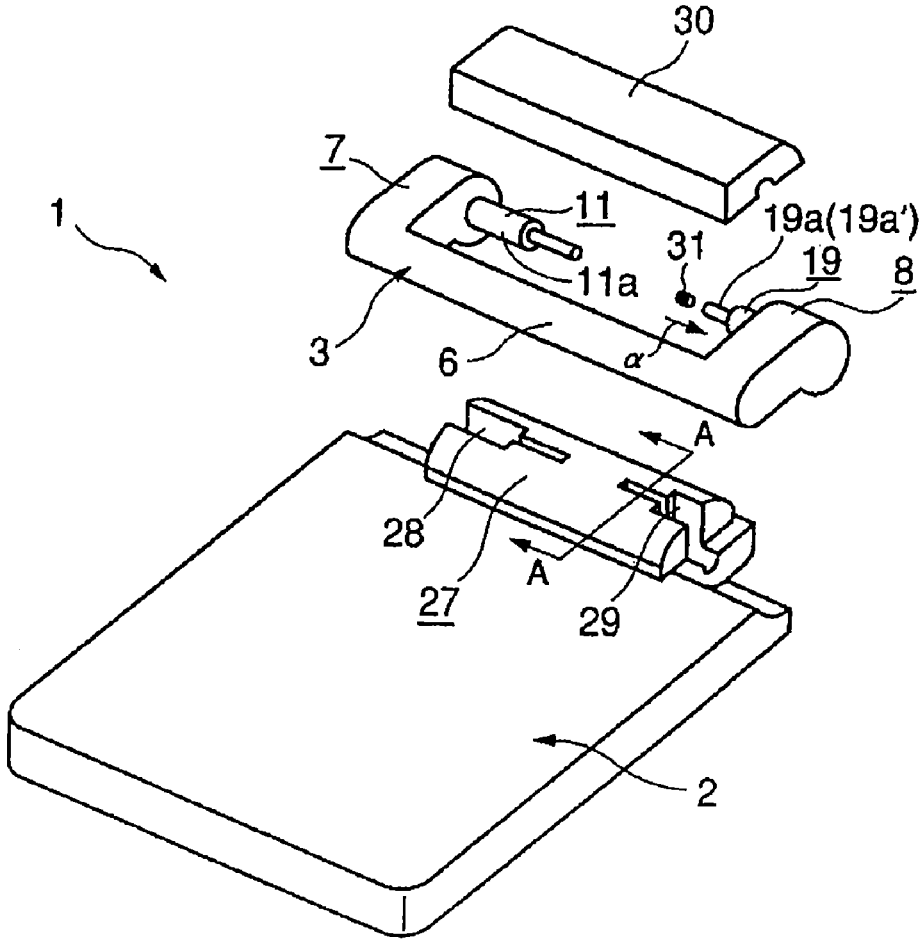
FIG. 1*b* is an exploded view schematically illustrating the card-type device of FIG. 1*a*.

Embodiments of the present invention will be described hereinafter with reference to the accompanying drawings. FIG. 1*a* is a schematic view illustrating a card-type device according to a first embodiment. FIG. 1*b* is an exploded view schematically illustrating the card-type device of FIG. 1*a*. A card-type device 1 according to the first embodiment has a wireless communication function, and the card-type device 1 includes a flat housing 2 which accommodates a circuit board (not shown), and an antenna structure body 3 which is disposed outside of the housing 2 and which is used to perform wireless communication utilizing radio waves. The card-type device 1 is used by being inserted into a card slot of an information terminal apparatus such as a personal computer in a direction indicated by an arrow shown in FIG. 1*a*.

Figure 2A:
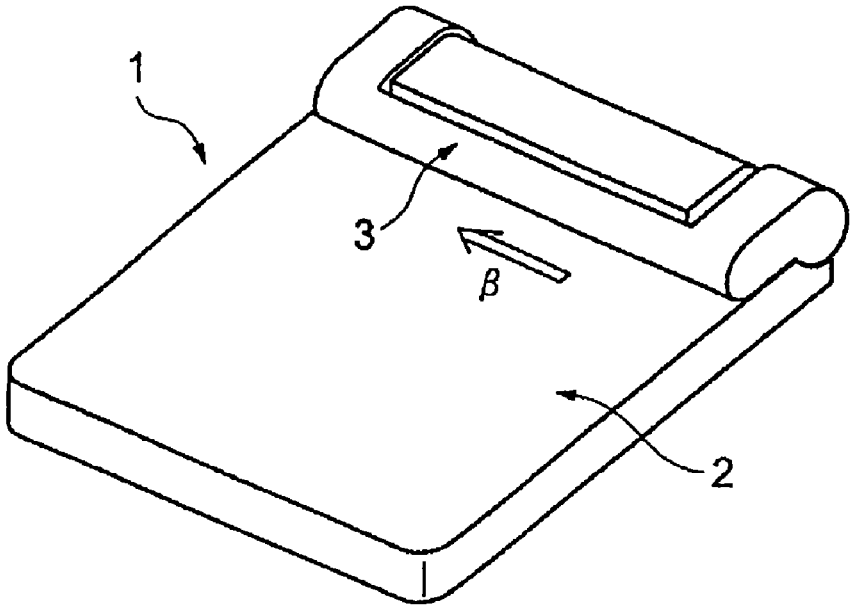
FIG. 2*a* is a diagram illustrating the card-type device according to the first embodiment in a flat position in which an antenna structure body is laid flat.
Figure 2B:
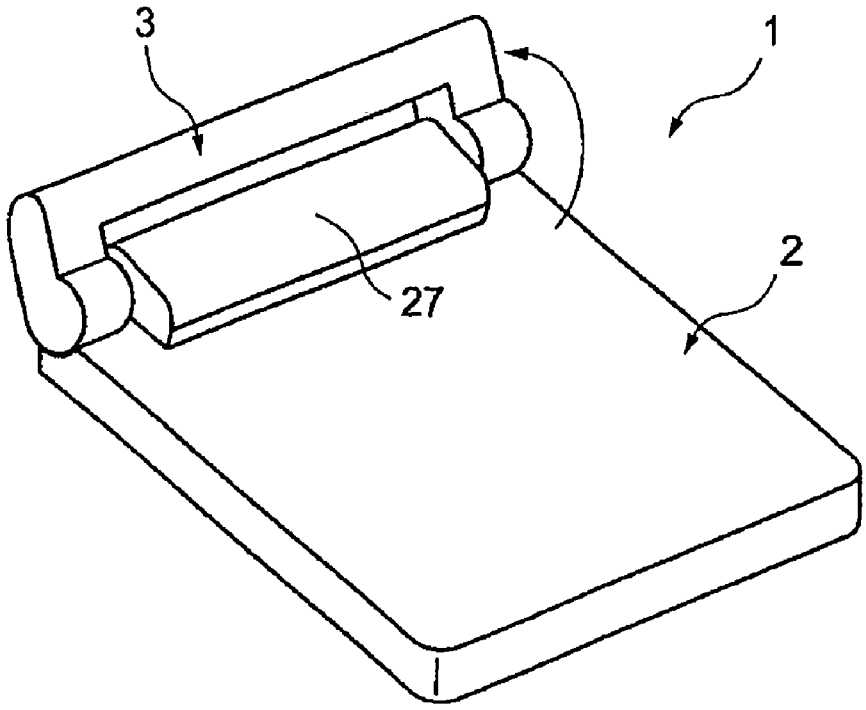
FIG. 2*b* is a diagram illustrating the card-type device according to the first embodiment in an upright position in which the antenna structure body stands.
Figure 3:
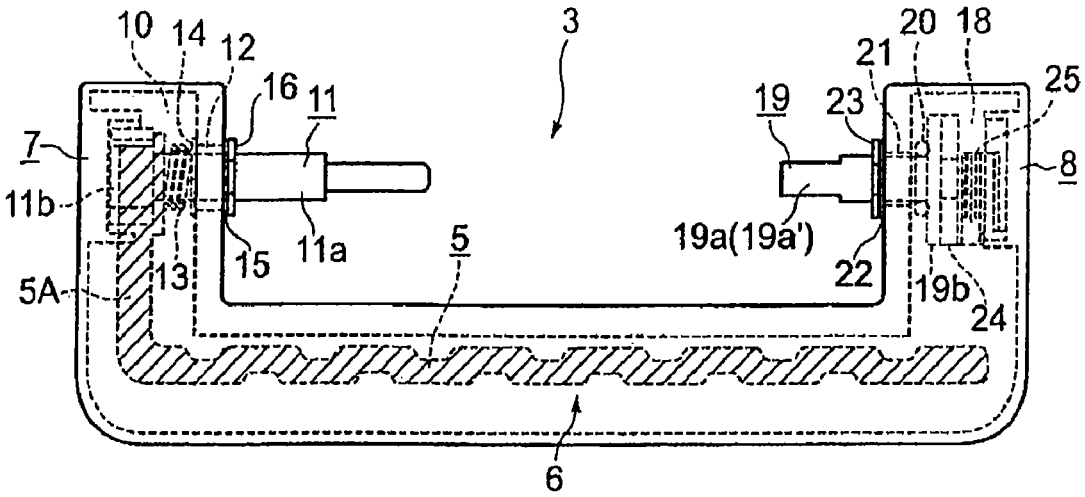
FIG. 3 is a diagram illustrating an inner configuration of the antenna structure body of the card-type device according to the first embodiment.

The antenna structure body 3 is disposed in a rear side of the housing 2 in the insertion direction and has the following configuration. The antenna structure body 3 is turntable within an operational range between a flat position to be laid flat on an upper surface of the housing 2 as shown in FIG. 2*a* and an upright position to stand on the upper surface of the housing 2 as shown in FIG. 2*b*. FIG. 3 shows the antenna structure body 3 schematically. The antenna structure body 3 includes an antenna body 5 which is a conductor and which performs wireless communication utilizing radio waves, an antenna cover 6 which is an insulator made of a resin material and which covers and protects the antenna body 5, and attachment portions 7 and 8 which are used for attachment to the housing 2.

In the first embodiment, the antenna body 5 has a meander shape and extends in a width direction perpendicular to the insertion direction of the card-type device 1. The antenna body 5 includes a feeding portion 5A in an extension which extends from one end of the meandering conductor (left end in FIG. 3) in a direction perpendicular to the antenna body extending direction.

The antenna cover 6 is long and extends in the antenna body extending direction, and the antenna body 5 is fixed in an inner space thereof. The antenna cover 6 has extensions which extend from both ends in a direction perpendicular to the extending direction of the antenna cover 6, and the extensions function as walls of the attachment portions 7 and 8. The walls define inner spaces 10 and 18 of the attachment portions 7 and 8 which are connected to the space which accommodates the antenna body 5.

Figure 4A:
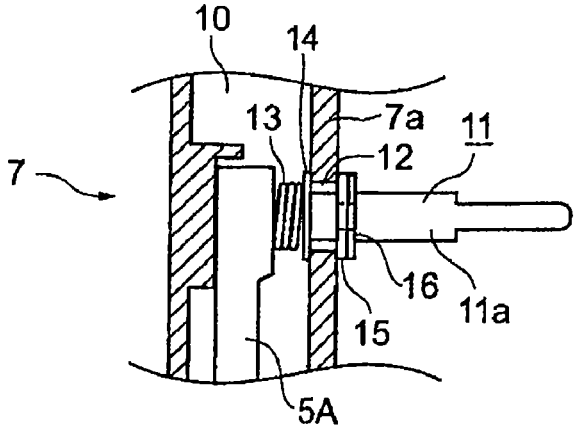
FIG. 4*a* is a sectional view schematically illustrating a configuration of an attachment portion of the antenna structure body which is disposed at the side of a feeding terminal of the antenna structure body.
Figure 4B:
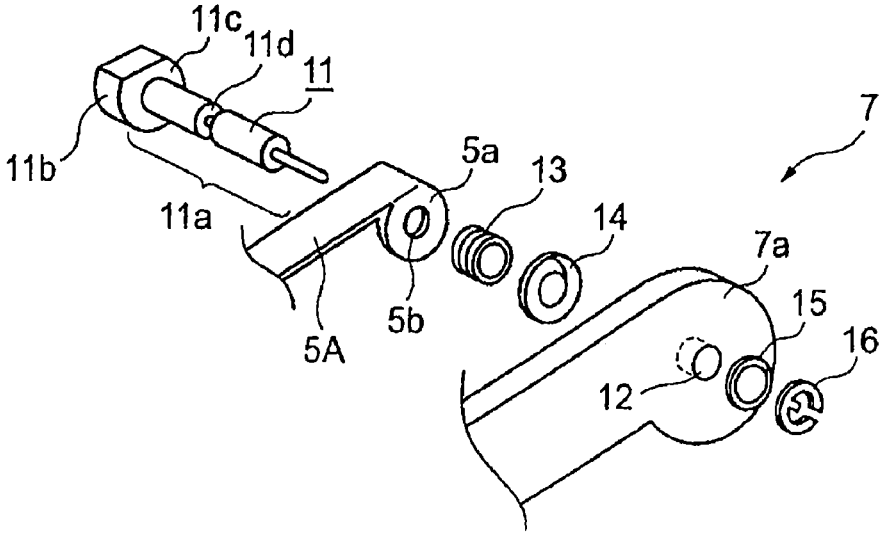
FIG. 4*b* is an exploded view schematically illustrating the attachment portion of the antenna structure body which is disposed at the side of the feeding terminal of the antenna structure body.

FIG. 4*a* is a sectional view schematically illustrating an exemplary internal structure of the attachment portion 7, and FIG. 4*b* is an exploded view schematically illustrating the attachment portion 7. The attachment portion 7 includes a feeding terminal 11. The feeding terminal 11 includes a stick portion 11*a* and a flange portion 11*b* which is attached to one end of the stick portion 11*a*. The feeding terminal 11 is entirely formed of a conductor. The feeding portion 5A of the antenna body 5 has a plane 5*a* which is parallel to a surface 11*c* of the flange portion 11*b* of the feeding terminal 11 (refer to FIG. 4*b*) A through-hole 5*b* is made in the plane 5*a* so that the stick portion 11*a* of the feeding terminal 11 penetrates through the plane 5*a*. The feeding terminal 11 is coupled to the antenna body 5 by inserting the stick portion 11*a* into the through-hole 5*b* made in the plane 5*a* of the feeding portion 5A. The surface 11*c* of the flange portion 11*b* comes into contact with the plane 5*a* of the feeding portion 5A, and thereby, the feeding terminal 11 is electrically connected to the antenna body 5.

The attachment portion 7 includes a wall 7*a* which faces the attachment portion 8, and a through-hole 12 for a feeding terminal is made in the wall 7*a*. In a state in which the stick portion 11*a* of the feeding terminal 11 penetrates the plane 5*a* of the antenna body 5, a spring 13 and a washer 14 in this order, the stick portion 11*a* is inserted into the through-hole 12 made in the wall 7*a* of the attachment portion 7 to penetrate the wall 7*a* from the side of the space 10 and projects outward from the attachment portion 7. The stick portion 11*a* has a groove 11*d* on an outer circumferential surface, in a portion projecting from the attachment portion 7. The projecting portion of the stick portion 11*a* pierces through a washer 15. Furthermore, an E-ring 16 is attached to the groove 11*d* in the projecting portion of the stick portion 11*a* such that the E-ring 16 presses the wall 7*a* of the attachment portion 7 through the washer 15. The feeding terminal 11 is fixed to the wall 7*a* of the attachment portion 7 so as not to slip from the wall 7*a*. In the state in which the feeding terminal 11 is fixed to the wall 7*a* of the attachment portion 7 so as not to slip from the wall 7*a* as described above, the spring 13 is compressed between the plane 5*a* of the feeding portion 5A of the antenna body 5 and the washer 14. Therefore, the spring 13 presses the washer 14 against an inner surface of the wall 7*a* of the attachment portion 7, and presses the plane 5*a* of the feeding portion 5A of the antenna body 5 against the surface 11*c* of the flange portion 11*b* of the feeding terminal 11. Since the plane 5*a* of the feeding portion 5A pushes the surface 11*c* of the feeding terminal 11, surface contact between the plane 5*a* and the stick portion 11*a* is enhanced. Accordingly, the electrical connection between the feeding portion 5A of the antenna body 5 and the feeding terminal 11 is more reliable.

The feeding terminal 11 is arranged in the attachment portion 7 as described above, and along with a turning motion of the antenna structure body 3 between the upright position to stand on the upper surface of the housing 2 and the flat position to be laid flat on the upper surface of the housing 2, the feeding terminal 11 turns on an axis extending in a longitudinal direction of the stick portion 11*a*.

Figure 5A:
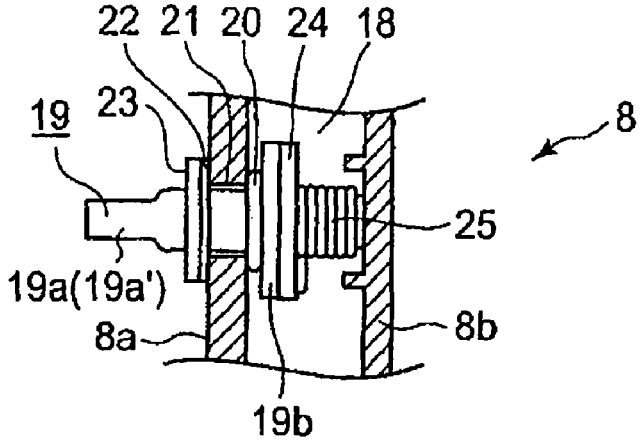
FIG. 5*a* is a sectional view schematically illustrating a configuration of another attachment portion of the antenna structure body which is disposed at the side of a turning shaft of the antenna structure body.
Figure 5B:
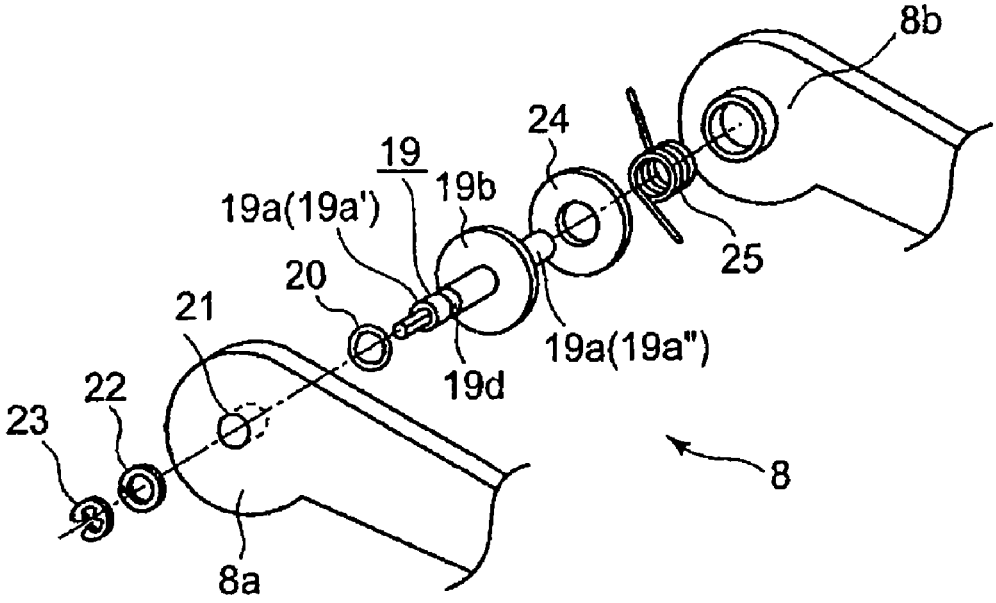
FIG. 5*b* is an exploded view schematically illustrating the portion of the antenna structure body shown in FIG. 5*a*.

FIG. 5*a* is a diagram illustrating an exemplary internal structure of the attachment portion 8, and FIG. 5*b* is an exploded view schematically illustrating the attachment portion 8. The attachment portion 8 has a turning shaft 19 serving as the axis of turn. The turning shaft 19 includes a stick portion 19*a* and a flange portion 19*b* arranged in a position between opposite ends of the stick portion 19*a*. In the turning shaft 19, a tip end of a first stick portion 19*a*' arranged on the left side of the flange portion 19*b* in FIGS. 5*a* and 5*b* has opposite flat surfaces facing each other as shown in the sectional view of FIG. 5*c*.

The attachment portion 8 includes a wall 8*a* which faces the attachment portion 7, and a through-hole 21 for the turning shaft is made in the wall 8*a*. In a state in which the first stick portion 19*a*' of the turning shaft 19 pierces through an O-ring 20, the first stick portion 19*a*' penetrates the wall 8*a* from the space 18 inside the attachment portion 8 and projects outward through the through-hole 21. A groove 19*d* is formed on an outer circumference of the first stick portion 19*a*', in a portion projecting outward from the inner space 18 of the attachment portion 8. The projecting portion of the first stick portion 19*a*' pierces through a washer 22. Furthermore, an E-ring 23 is attached to the groove 19*d* formed in the projecting portion of the first stick portion 19*a*' such that the E-ring 23 presses the wall 8*a* of the attachment portion 8 through the washer 22. The turning shaft 19 is fixed to the wall 8*a* of the attachment portion 8 so as not to slip from the wall 8*a*.

In the state in which the turning shaft 19 is fixed to the wall 8*a* of the attachment portion 8 so as not to slip from the wall 8*a* as described above, the flange portion 19*b* of the turning shaft 19 pushes the O-ring 20 toward the wall 8*a* of the attachment portion 8. An axis of the turning shaft 19 and an axis of the feeding terminal 11 provided in the attachment portion 7 are arranged in a virtual line.

As shown in FIGS. 5*a* and 5*b*, a spring fixing member 24 is integrally fixed to a right surface of the flange portion 19*b* of the turning shaft 19. A turning spring 25 (torsion spring, for example) which is an elastic member for turning the antenna is arranged in a second stick portion 19*a*" which is located at the right side of the flange portion 19*b* of the turning shaft 19. An end of the second stick portion 19*a* ', of the turning shaft 19 abuts on or is positioned at a small distance from a wall 8*b* facing the wall 8*a* of the attachment portion 8. One end of the turning spring 25 is fixed to the spring fixing member 24, and the other end of the spring 25 is fixed to the wall 8*b* of the attachment portion 8.

Figure 6A:
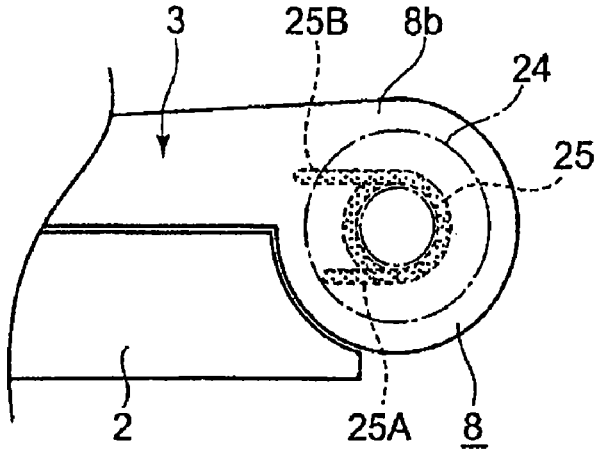
FIG. 6*a* is a diagram illustrating an antenna turning elastic member in a compressed state which is used to urge the antenna structure body in a direction in which the antenna structure body turns to stand.
Figure 6B:
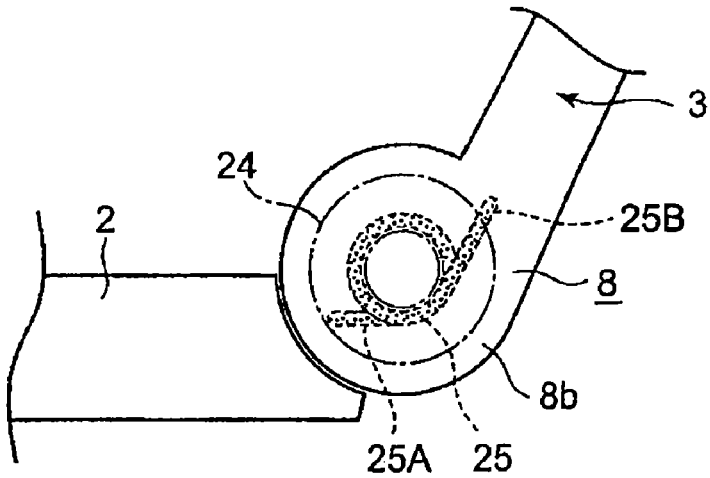
FIG. 6*b* is a diagram illustrating the antenna turning elastic member in a released state.

The turning shaft 19 is non-rotatably supported by the housing 2, as will be described hereinafter. The antenna structure body 3 turns on the turning shaft 19 within an operation range between the upright position to stand on the upper surface of the housing 2 and the flat position to be laid flat. FIGS. 6*a* and 6*b* are diagrams illustrating the turning spring 25 viewed from the wall portion 8*b* of the attachment portion 8. A first end 25A of the turning spring 25 is fixed to the spring fixing member 24 (that is, fixed to the turning shaft 19) as shown in FIGS. 6*a* and 6*b*, and a second end 25B of the turning spring 25 is fixed to the wall 8*b* of the attachment portion 8. Therefore, when the antenna structure body 3 turns, the second end 25B of the turning spring 25 turns in accordance with the turning motion of the wall 8*b* of the attachment portion 8. On the other hand, the first end 25A of the turning spring 25 does not turn since the turning shaft 19 does not turn. Accordingly, when the antenna structure body 3 turns, the positional relationship between the first end 25A and the second end 25B of the turning spring 25 is changed, and elastic deformation of the turning spring 25 is caused. Specifically, in this first embodiment, when the antenna structure body 3 stands on the upper surface of the housing 2, the turning spring 25 is released as shown in FIG. 6*b*. On the other hand, when the antenna structure body 3 is laid flat on the upper surface of the housing 2, the turning spring 25 is compressed as shown in FIG. 6*a*. Consequently, when the antenna structure body 3 is laid flat on the upper surface of the housing 2, the turning spring 25 urges the antenna structure body 3 in a direction toward the upright position.

When the antenna structure body 3 turns, friction is generated in a portion where the O-ring 20 abuts on the wall 8*a* of the attachment portion 8 and in a portion where the O-ring 20 abuts on the flange portion 19*b* of the turning shaft 19. The friction enables the antenna structure body 3 to keep in the upright position, and the inclination of the antenna structure body 3 to be controlled. Specifically, the wall 8*a* of the attachment portion 8, the O-ring 20 and the flange portion 19*b* of the turning shaft 19 constitute an inclination control unit which continuously controls the inclination of the antenna structure body 3 in the standing state with respect to the upper surface of the housing 2. Since the inclination control unit is provided, the following advantages are obtained. Strength of radio waves around the card-type device 1 utilized for wireless communication is not stable. However, because of the inclination control unit, the angle of the inclination of the antenna structure body 3 can be changed in accordance with the strength of the radio waves around the card-type device 1 utilized for wireless communication so that the antenna will have high sensitivity to the radio waves. Consequently, wireless communication performance of the card-type device 1 is readily improved, and reliability of the card-type device 1 for wireless communication is enhanced.

The antenna structure body 3 is configured as described above. The antenna structure body 3 is disposed on the housing 2 by being supported by an antenna structure support 27 disposed on the rear side of the housing 2 in the insertion direction as shown in FIG. 1*b*. The antenna structure support 27 has recessed portions 28 and 29 and a cover 30. The stick portion 11*a* of the feeding terminal 11 of the antenna structure body 3 is entirely fitted into the recessed portion 28, and the recessed portion 28 serves as a bearing. The recessed portion 28 has an opening in the bottom. A feeding unit (not shown) disposed inside of the housing 2 is directly connected to the stick portion 11*a* of the feeding terminal 11 through the opening of the recessed portion 28. The feeding unit is used to electrically connect a high-frequency circuit (not shown) for the wireless communication disposed on a circuit board accommodated in the housing 2 to the feeding terminal 11. Note that various types of feeding units exist, and a feeding unit of any type may be employed herein. The description of the configuration of the feeding unit is omitted.

Figure 5C:
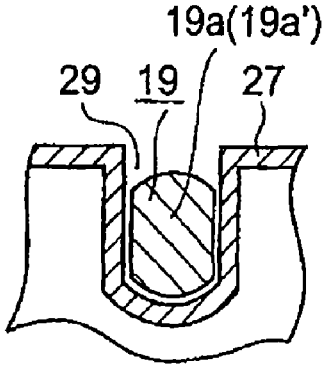
FIG. 5*c* is a sectional view schematically illustrating the turning shaft disposed in a housing.

Meanwhile, the recessed portion 29 serves as a bearing for receiving the stick portion 19*a* (19*a*') of the turning shaft 19 of the antenna structure body 3, and the stick portions 19*a* (19*a*') is entirely fitted into the recessed portion 29. In this first embodiment, the tip end of the stick portion 19*a* (19*a*') of the turning shaft 19 is shaped as schematically shown in the sectional view of FIG. 5*c*. The recessed portion 29, in which the stick portion 19*a* (19*a*') is fitted, has a cross section of a shape in accordance with the shape of the stick portion 19*a* (19*a*') of the turning shaft 19 so as not to allow the turning shaft 19 to rotate. That is, the turning shaft 19 is supported by the housing 2 such that the turning shaft 19 is prevented from rotating. FIG. 5*c* is a sectional view taken along a line A-A of FIG. 1*b*.

In addition to the turning shaft 19, a spring 31 which urges the tip end of the turning shaft 19 is accommodated in the recessed portion 29. The spring 31 applies an urging force on the turning shaft 19 in the right direction indicated by a along the axis of the turning shaft 19 extending in the longitudinal direction when the spring 31 is accommodated in the recessed portion 29 along with the turning shaft 19.

The cover 30 covers the recessed portions 28 and 29 so as to prevent the feeding terminal 11 and the turning shaft 19 from slipping off the recessed portions 28 and 29 and to protect the feeding terminal 11 and the turning shaft 19.

In the first embodiment, the feeding terminal 11 and the turning shaft 19 of the antenna structure body 3 are accommodated in the recessed portions 28 and 29 of the antenna structure support 27, respectively, and the recessed portions 28 and 29 are covered with the cover 30. Thus, the antenna structure body 3 is supported by the antenna structure support 27. In the first embodiment, the attachment portions 7 and 8 of the antenna structure body 3 are disposed at the opposite sides of the antenna structure support 27 in the width direction thereof. A distance between the attachment portions 7 and 8 is larger than the width of the antenna structure support 27. Since there is a difference between the distance between the attachment portions 7 and 8 and the width of the antenna structure support 27, the antenna structure body 3 is disposed on the housing 2 so as to move in the width direction of the housing 2 in a range within the difference. That is, the antenna structure body 3 is attached to the housing 2 through the turning shaft (turning center shaft) 19 so as to move in a direction along the turning shaft (turning center shaft) 19 within an allowable movement range. In the first embodiment, however, since the spring 31 urges the turning shaft 19 in the direction indicated by α as described above, with no external force applied, the antenna structure body 3 is arranged in the right most position where the attachment portion 7 abuts on the antenna structure support 27.

Figure 7A:
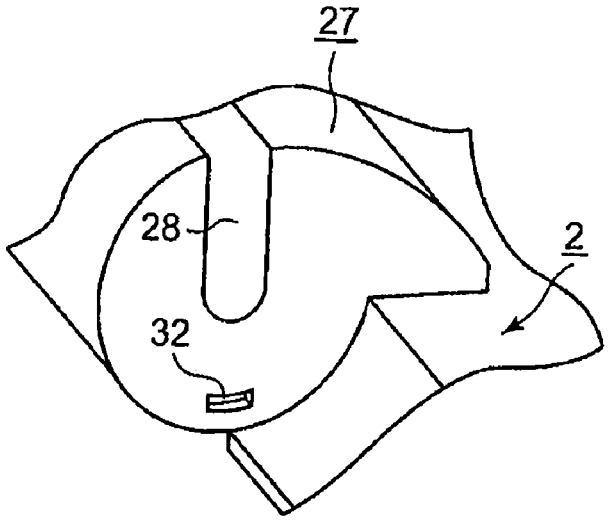
FIG. 7*a* is a diagram illustrating a locking portion of a locking mechanism (first locking mechanism) of the antenna structure body.
Figure 7B:
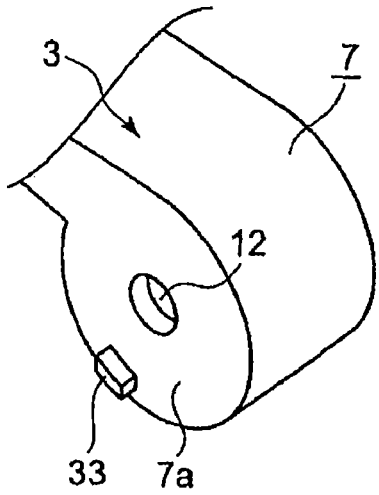
FIG. 7*b* is a diagram illustrating a locking projection of the locking mechanism (first locking mechanism) of the antenna structure body.
Figure 7C:
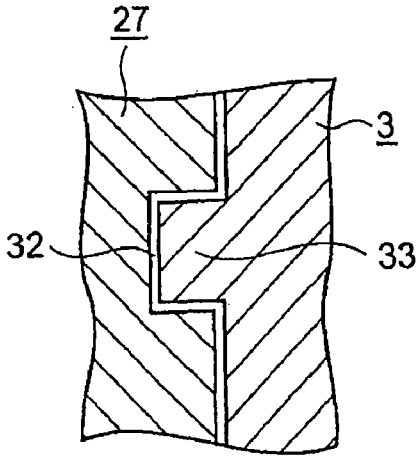
FIG. 7*c* is a sectional view schematically illustrating the locking projection and the locking portion of the locking mechanism (first locking mechanism) of the antenna structure body, which are in engagement with each other.

In the first embodiment, as shown in FIG. 7*a*, a recess 32 is formed on a wall surface of the antenna structure support 27 (housing 2) facing the wall 7*a*. Furthermore, a locking projection 33 is formed on the wall 7*a* of the attachment portion 7 of the antenna structure body 3 as shown in FIG. 7*b*. The locking projection 33 is formed in a position to be fitted into the recess 32 of the antenna structure support 27 when the antenna structure body 3 is laid flat on the upper surface of the housing 2. As shown in FIG. 7*c*, since the locking projection 33 of the antenna structure body 3 is fitted in the recess 32 of the antenna structure support 27, the turning motion of the antenna structure body 3 toward the upright position by the urging force of the turning spring 25 is stopped. Specifically, while the antenna structure body 3 is laid flat, the locking projection 33 is fitted and locked in the recess 32, and thus, the recess 32 serves as a locking member for preventing the antenna structure body 3 from turning toward the upright position urged by the turning spring 25. The recess 32 and the locking projection 33 constitute a locking mechanism (first locking mechanism) for keeping the antenna structure body 3 laid flat. The spring 31 applies a force to the antenna structure body 3 to urge the antenna structure body 3 entirely rightward in FIG. 1*b* relative to the antenna structure support 27. Accordingly, the locking projection 33 of the antenna structure body 3 is pressed against the inner surface of the recess 32 formed on a side portion of the antenna structure support 27, and therefore, it is difficult to separate the locking projection 33 from the recess 32. That is, the spring 31 is a locking elastic member for urging the antenna structure body 3 in a locking direction along the turning center shaft. With this configuration having the spring 31 serving as the locking elastic member as described above, the locking projection 33 is more firmly fitted in the recess 32 using the urging force of the spring 31, and the antenna structure body 3 can be maintained in the flat position stably.

Figure 8A:
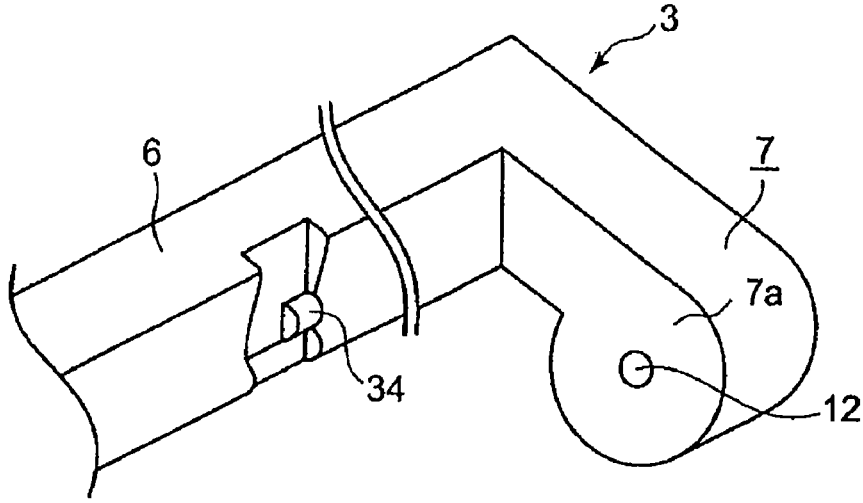
FIG. 8*a* is a diagram illustrating a locking projection of another locking mechanism (second locking mechanism) of the antenna structure body.
Figure 8B:
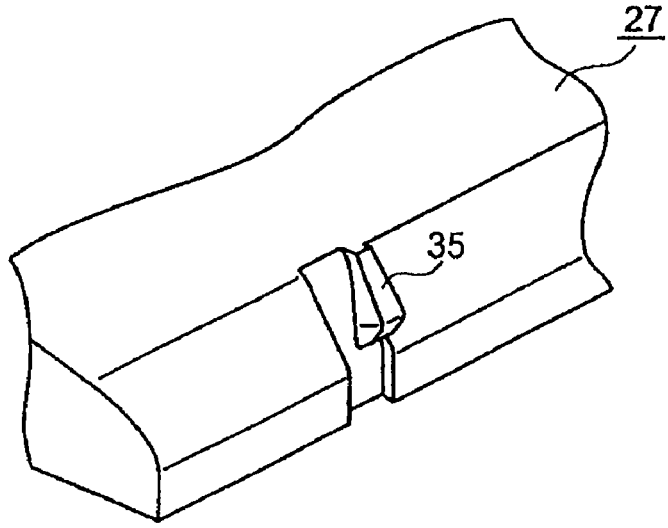
FIG. 8*b* is a diagram illustrating a locking portion of the locking mechanism (second locking mechanism) of the antenna structure body.
Figure 8C:
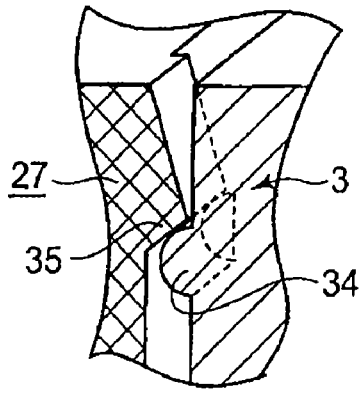
FIG. 8*c* is a diagram schematically illustrating the locking projection and the locking portion of the locking mechanism (second locking mechanism) of the antenna structure body, which are in engagement with each other.

In the first embodiment, in addition to the locking mechanism (first locking mechanism) for the antenna structure body 3 including the locking projection 33 of the antenna structure body 3 and the recess 32 of the antenna structure support 27 serving as the locking member for the locking projection 33, a second locking mechanism is provided. The second locking mechanism includes a locking projection 34 as shown in FIG. 8*a* which is formed on the antenna cover 6 of the antenna structure body 3 at the side of the antenna structure support 27 and a locking portion 35 as shown in FIG. 8*b* which is disposed on the antenna structure support 27 so as to face the locking projection 34 when the antenna structure body 3 is laid flat. In the second locking mechanism, as shown in FIG. 8*c*, when the antenna structure body 3 is laid flat on the upper surface of the housing 2, the locking projection 34 of the antenna structure body 3 is locked in the locking portion 35 of the antenna structure support 27, and serves as an auxiliary stopper for preventing the antenna structure body 3 from turning toward the upright position urged by the turning spring 25. Because of the second locking mechanism as described above, the antenna structure body 3 can be kept in the flat position more reliably.

Figure 7D:
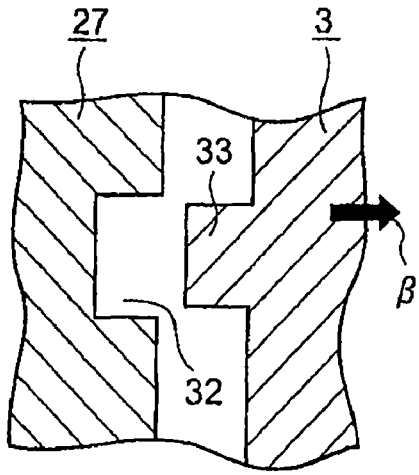
FIG. 7*d* is a sectional view schematically illustrating the locking projection and the locking portion of the locking mechanism (first locking mechanism) of the antenna structure body, which are released from each other.
Figure 8D:
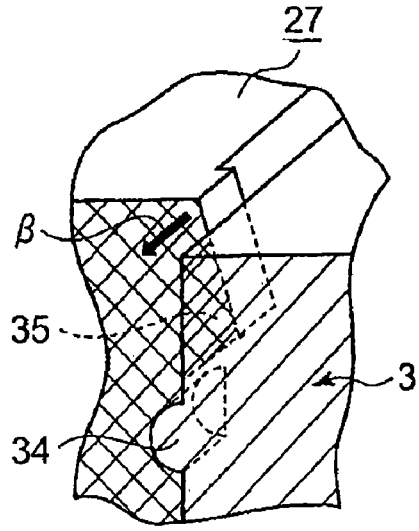
FIG. 8*d* is a sectional view schematically illustrating the locking projection and the locking portion of the locking mechanism (second locking mechanism) of the antenna structure body, which are released from each other.

In the first embodiment, while the antenna structure body 3 is maintained in the flat position by the first and second locking mechanisms, when the antenna structure body 3 entirely moves in a direction indicated by β shown in FIG. 2*a* along the turning center shaft, that is, in an unlocking direction, against the urging force of the spring 31, the locking projection 33 of the antenna structure body 3 is detached from the recess 32 of the antenna structure support 27 as shown in FIG. 7*d*. Furthermore, following this movement of the antenna structure body 3 in the unlocking direction, the locking projection 34 of the antenna structure body 3 moves in a direction to be released from the locking portion 35 of the antenna structure support 27 as shown in FIG. 8*d*. As described above, since the antenna structure body 3 moves in the unlocking direction, the first and second locking mechanisms are unlocked, and the antenna structure body 3 automatically turns toward the upright position by the urging force of the turning spring 25.

Furthermore, when the antenna structure body 3 entirely is turned to the upper surface of the housing 2 against the urging force of the turning spring 25 and is laid flat, the locking projection 33 of the antenna structure body 3 is fitted into the recess 32 of the antenna structure support 27, and the locking projection 34 of the antenna structure body 3 is fitted into the locking member 35 of the antenna structure support 27. Accordingly, the antenna structure body 3 is locked and maintained in the flat position.

A second embodiment will be described hereinafter. Note that, in a description of the second embodiment, components the same as those of the first embodiment are denoted by the same reference numerals, and descriptions of common components are omitted.

Figure 9:
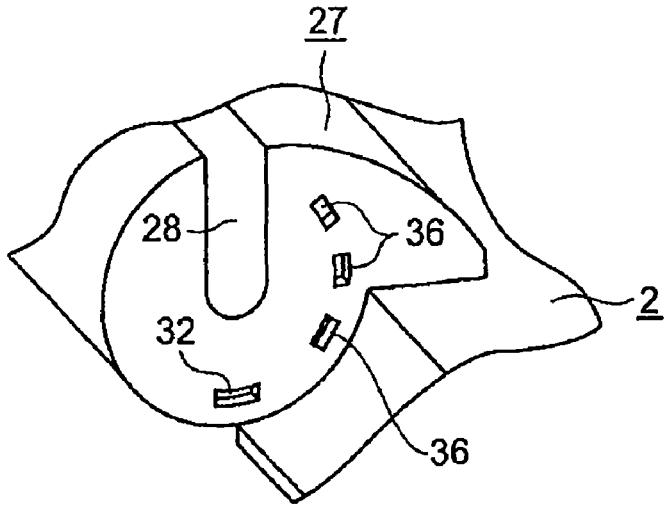
FIG. 9 is a diagram illustrating a characteristic portion of a configuration according to a second embodiment.

The second embodiment is based on the configuration of the first embodiment, and furthermore, a plurality of recesses 36 are arranged, in addition to a recess 32, on a surface of an antenna structure support 27 which faces a wall 7*a* of an attachment portion 7 as shown in FIG. 9. The plurality of recesses 36 are arranged at intervals along a trajectory of a locking projection 33 of an antenna structure body 3 generated when the antenna structure body 3 turns. The recesses 36 are shallower than the recess 32. The inclination of the antenna structure body 3 in the standing state can be controlled by clicking the antenna structure body 3 so as to lock the projection 33 in one of the recesses 36. That is, the plurality of recesses 36 serve as an inclination control unit which controls the inclination of the antenna structure body 3 in the standing state step by step. Configurations of the other parts are the same as those of the first embodiment.

A third embodiment will be described hereinafter. Note that, in a description of the third embodiment, components the same as those of the first and second embodiments are denoted by the same reference numerals, and descriptions of common components are omitted.

In the third embodiment, in a portion between a turning spring 25 and a spring fixing member 24 which are rubbed against each other when an antenna structure body 3 turns on a turning shaft 19 and in a portion between the turning spring 25 and an inner surface of a wall 8*b* of an attachment portion 8, grease (such as silicone grease) is filled. The grease has high viscosity and functions as a damper which reduces the turning speed of the antenna structure body 3 on the turning shaft 19 toward the upright position or toward the flat position. Configurations of the other parts of a card-type device 1 according to the third embodiment are the same as those in the first and second embodiments.

In the third embodiment, the grease is arranged as a damper in an inner space 18 of the attachment portion 8 of the antenna structure body 3. A through-hole 21 for the turning shaft which opens to the outside of the inner space 18 is formed on the wall 8*a* of the attachment portion 8, and a tip end of the turning shaft 19 projects outward through the through-hole 21. Here, there is concern that the grease filled in the inner space 18 of the attachment portion 8 may leak to the outside through a gap between the turning shaft 19 and an inner surface of the through-hole 21 or the grease may intrude into the inside of the housing 2 through the turning shaft 19, thereby causing trouble in an electronic circuit included in the housing 2. To avoid this concern, in the third embodiment, an O-ring 20 is fitted to the turning shaft 19 so as to close an opening of the gap between the turning shaft 19 and the inner surface of the through-hole 21. In this way, the grease is prevented from leaking to the outside and from intruding into the housing 2.

Furthermore, in the third embodiment, a feeding terminal 11 is provided separately from the turning shaft 19. Therefore, even when the grease is applied to components relating to a turning motion of the antenna structure body 3 on the turning shaft 19, the grease does not intrude into a contact portion between the feeding terminal 11 and a feeding unit arranged in a circuit board. Accordingly, the occurrence of a conduction defect between the feeding terminal 11 and the feeding unit due to the grease can be avoided.

In the third embodiment, since the grease is arranged as a damper in the portions in which two components are rubbed against each other when the antenna structure body 3 turns around the housing 2 on the turning shaft 19, the turning speed of the antenna structure body 3 can be reduced. Because the turning speed of the antenna structure body 3 is reduced and because the damper is provided, grind and wearing-out of components due to the rubbing motion are suppressed, and furthermore, aging degradation of the components relating to the turning motion of the antenna structure body 3 is suppressed. Thereby, the durability of the card-type device 1 is improved. Also, since the turning speed of the antenna structure body 3 is reduced, the high grade of the card-type device 1 can be appealed.

Furthermore, in the third embodiment, the feeding terminal 11 which is electrically connected to a circuit of the circuit board incorporated in the housing 2 is arranged in the antenna structure body 3 so as to integrally turn with the antenna structure body 3. Therefore, when the feeding terminal 11 turns along with the turning motion of the antenna structure body 3, the feeding terminal 11 and the feeding unit which is a connection portion (the contact portion) between the feeding terminal 11 and the circuit board are rubbed against each other. In this structure, as described in the third embodiment, by providing means for reducing the turning speed of the antenna structure body 3 toward the upright position and toward the flat position, wear occurring due to the rubbing motion between the feeding terminal 11 and the feeding unit is suppressed. Accordingly, the durability of each of the feeding terminal 11 and the feeding unit is enhanced.

A fourth embodiment will be described hereinafter. Note that, in a description of the fourth embodiment, components the same as those of the first, second, and third embodiments are denoted by the same reference numerals, and descriptions of common components are omitted.

Figure 10A:
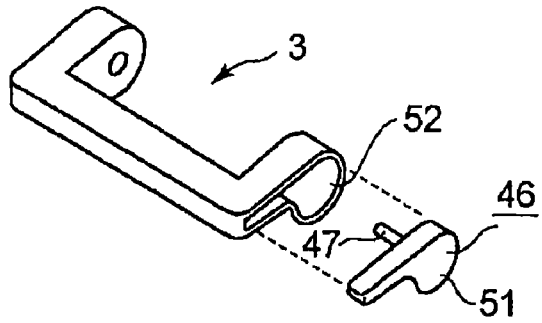
FIG. 10*a* is a diagram illustrating an arrangement of a turning mechanism unit of an antenna structure body of a card-type device according to a fourth embodiment.

In the fourth embodiment, components relating to a turning mechanism of an antenna structure body 3 are configured as a unit, that is, a turning mechanism unit 46 as shown in FIG. 10*a*. The turning mechanism unit 46 is incorporated in the antenna structure body 3.

Figure 10B:
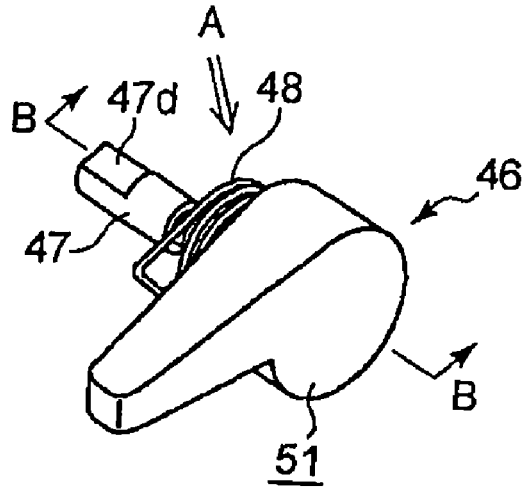
FIG. 10*b* is a diagram illustrating the turning mechanism unit.
Figure 10C:
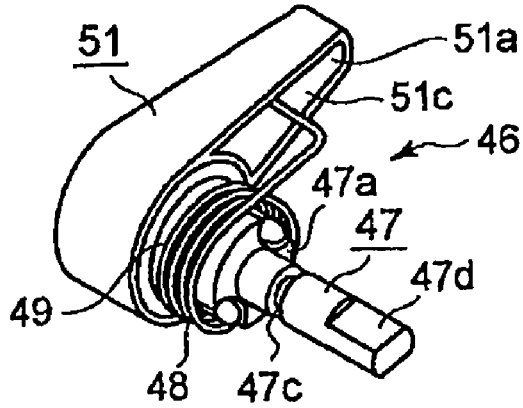
FIG. 10*c* is a diagram illustrating the turning mechanism unit viewed from a direction indicated by an arrow A shown in FIG. 10*b*.
Figure 10D:
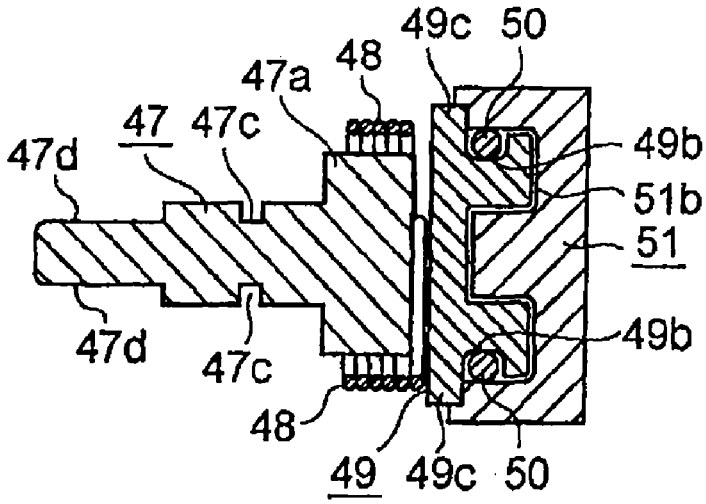
FIG. 10*d* is a sectional view schematically illustrating a portion taken along a line B-B shown in FIG. 10*b*.
Figure 10E:
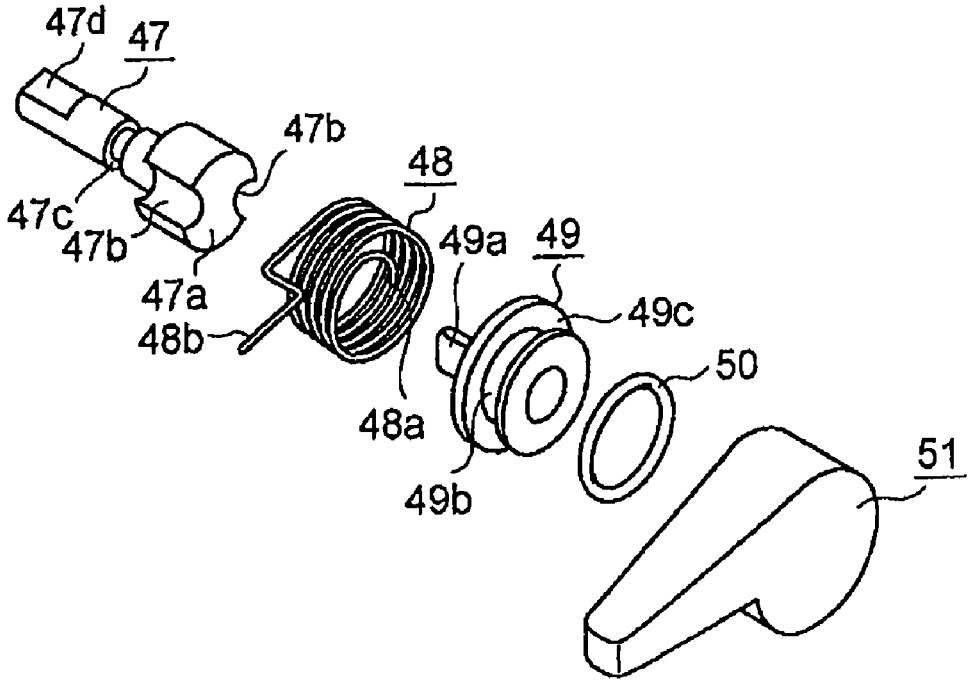
FIG. 10*e* is an exploded view schematically illustrating the turning mechanism unit of FIG. 10*b*.

FIG. 10*b* is a perspective view schematically illustrating the turning mechanism unit 46. FIG. 10*c* is a perspective view schematically illustrating the turning mechanism unit 46 viewed from a direction indicated by an arrow A shown in FIG. 10*b*. FIG. 10*d* is a sectional view schematically illustrating the turning mechanism unit 46 taken along line B-B of FIG. 10*b*. FIG. 10*e* is an exploded view schematically illustrating the turning mechanism unit 46. As shown in FIGS. 10*a* to 10*e*, in the fourth embodiment, the turning mechanism unit 46 includes a turning shaft 47, a turning spring 48 which is an elastic member for turning an antenna, a spring fixing member 49, an O-ring 50, and a unit case 51.

The turning shaft 47 has a flange portion 47*a* at one end thereof (refer to FIG. 10*e*, for example), and the turning spring 48 is fitted to the outer circumference of the flange portion 47*a*. The spring fixing member 49 has a plane which abuts on an entire end surface of the flange portion 47*a* of the turning shaft 47, and a plurality of hooks 49*a* protrude from the plane. The flange portion 47*a* of the turning shaft 47 has locking portions 47*b* on which the hooks 49*a* are hooked and fixed. Since the hooks 49*a* are hooked and fixed on the corresponding locking portions 47*b* of the turning shaft 47, the spring fixing member 49 is fixed to the turning shaft 47, and thus, a turning center shaft is configured. Furthermore, a first end 48*a* of the turning spring 48 is sandwiched between the spring fixing member 49 and the flange portion 47*a* of the turning shaft 47 so as to be fixedly supported by an assembled body (the turning center shaft) constituted by the spring fixing member 49 and the turning shaft 47.

The unit case 51 has an open side 51*a* (refer to FIG. 10*c*) and a receiving portion 51*b* (refer to FIG. 10*d*). The end of the assembled body (turning center shaft), composed of the spring fixing member 49 and the turning shaft 47, at the side of the spring fixing member 49 is inserted into the open side 51*a* and is rotatably fitted in the receiving portion 51*b*. The spring fixing member 49 has a groove 49*b* which extends along the outer circumference of a portion fitted in the receiving portion 51*b*. The O-ring 50 is fitted in the groove 49*b*, and the end of the turning center shaft at the side of the spring fixing member 49 is fitted in the receiving portion 51*b* of the unit case 51. Grease is filled in a gap between an inner surface of the receiving portion 51*b* of the unit case 51 and the portion of the turning center shaft inserted into the receiving portion 51*b*, and the grease serves as a damper. In the fourth embodiment, the grease does not leak out of the unit case 51. Specifically, a flange portion 49*c* is disposed on the spring fixing member 49. The flange portion 49*c* closes an opening of the receiving portion 51*b* of the unit case 51 so as not to generate a gap when the end of the turning center shaft at the side of the spring fixing member 49 is fitted into the receiving portion 51*b* of the unit case 51. In this way, the grease filled in the receiving portion 51*b* is prevented from leaking out of the receiving portion 51*b*.

The unit case 51 further includes a spring support 51*c*. The spring support 51*c* supports a second end 48*b* of the turning spring 48 while the first end 48*a* of the turning spring 48 is fixedly supported by the turning center shaft.

As described above, with regard to the turning center shaft which is an assembled body composed of the turning shaft 47 and the spring fixing member 49, the end of the turning center shaft at the side of the spring fixing member 49 is rotatably fitted in the receiving portion 51*b* of the unit case 51, whereas the other end projects outward from the open side 51*a* of the unit case 51. Like the turning shaft 19 described in each of the first to third embodiments, the portion of the turning center shaft which projects from the unit case 51 (turning shaft 47) has a groove 47*c* to which an E-ring 23 is fitted and a flat portion 47*d* which allows the turning shaft 47 to be fitted in a recess 29 of an antenna structure support 27 of a housing 2 in a non-rotatable state.

The turning mechanism unit 46 is configured as described above. An attachment portion 8 of the antenna structure body 3 includes a recess 52 in which the turning mechanism unit 46 (refer to FIG. 10*a*) is to be fitted, and a through-hole for a turning shaft is made in a bottom wall of the recess 52. The turning shaft 47 of the turning mechanism unit 46 is inserted into the through-hole and sticks out of the recess 52, and the unit case 51 of the turning mechanism unit 46 is inserted (pressed) into the recess 52, whereby the turning mechanism unit 46 is integrated with the antenna structure body 3. Note that when the turning mechanism unit 46 is integrated with the antenna structure body 3, like the turning shaft 19 described each of the first to third embodiments, a washer 22 and the E-ring 23 are fitted in this order to the projecting turning shaft 47 of the turning mechanism unit 46, and the E-ring 23 is fitted in the groove 47*c* of the turning shaft 47. Thereby, the turning shaft 47 is prevented from slipping off.

As described above, the antenna structure body 3 having the turning mechanism unit 46 integrated therewith is attached to the housing 2 as in the first to third embodiments, and turns on the turning center shaft, which is non-rotatably supported by the housing 2, within a range between an upright position to stand on an upper surface of the housing 2 maintained by an urging force of the turning spring 48 and a flat position to be laid flat. In the fourth embodiment, when the antenna structure body 3 turns, the unit case 51 of the turning mechanism unit 46 turns relative to the housing 2 whereas the turning center shaft of the turning mechanism unit 46 is supported by the housing 2 and does not turn. Therefore, a portion between the unit case 51 of the turning mechanism unit 46 and the portion of the turning center shaft which is fitted in the unit case 51 (that is, a portion between the inner surface of the receiving portion 51*b* of the unit case 51 and a circumferential surface of the spring fixing member 49) is a rubbed portion. In the fourth embodiment, since the grease serving as a damper is filled in the rubbed portion, the turning speed of the antenna structure body 3 with respect to the housing 2 can be reduced.

In the fourth embodiment, the turning spring 48 is fitted to the outer circumferential surface of the flange portion 47*a* of the turning shaft 47, and in this configuration, the turning spring 48 has a larger diameter as compared with a configuration in which the turning spring 48 is fitted to another portion of the turning shaft 47. Accordingly, the urging force of the turning spring 48 is readily controlled.

Configurations of the other parts of a card-type device 1 according to the fourth embodiment are the same as those in the first to third embodiments. In the fourth embodiment, components relating to the turning motion of the antenna structure body 3 are configured as a unit, that is, the turning mechanism unit 46. Accordingly, the number of components of the card-type device 1 can be reduced, and for example, management cost for the components can be reduced. Furthermore, assembling processes of the card-type device 1 can be simplified. In the fourth embodiment, since the grease serving as a damper is filled in the rubbed portion between the unit case 51 of the turning mechanism unit 46 and the portion of the turning center shaft which is fitted in the unit case 51, the following advantages are obtained. Since the grease is filled in the rubbed portion in the unit case 51 of the turning mechanism unit 46, the portion in which the grease is filled is configured as a sealed space (gap). Accordingly, the amount of grease to be filled in the rubbed portion is substantially constant irrespective of products. Furthermore, since the grease is prevented from leaking from the rubbed portion and accordingly from decreasing in amount, a problem that the turning speed of the antenna structure body 3 increases as the card-type device 1 is used for a long time is prevented.

Note that the present invention is not limited to the first to fourth embodiments, and various modifications may be made. For example, although the antenna body 5 has a meander shape in the first to fourth embodiments, there are no particular limitations to the configuration of the antenna body 5 including the shape as long as the antenna body 5 is capable of performing wireless communication in a predetermined frequency band, and the antenna body 5 is arbitrarily configured.

Figure 11A:
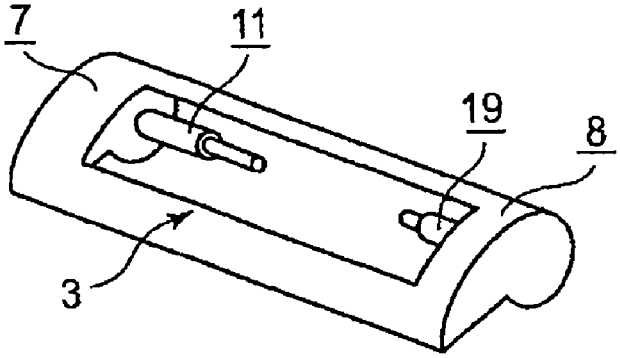
FIG. 11*a* is a diagram illustrating still another antenna structure body.
Figure 11B:
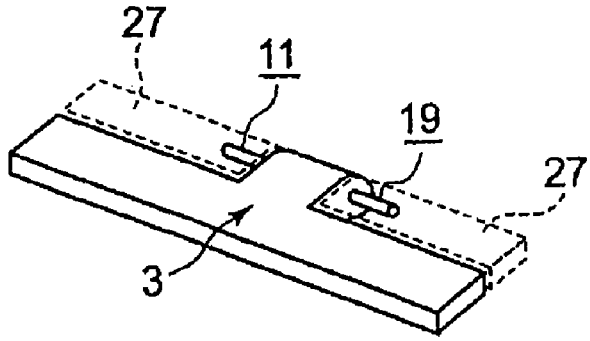
FIG. 11*b* is a diagram illustrating a further antenna structure body.
Figure 12:
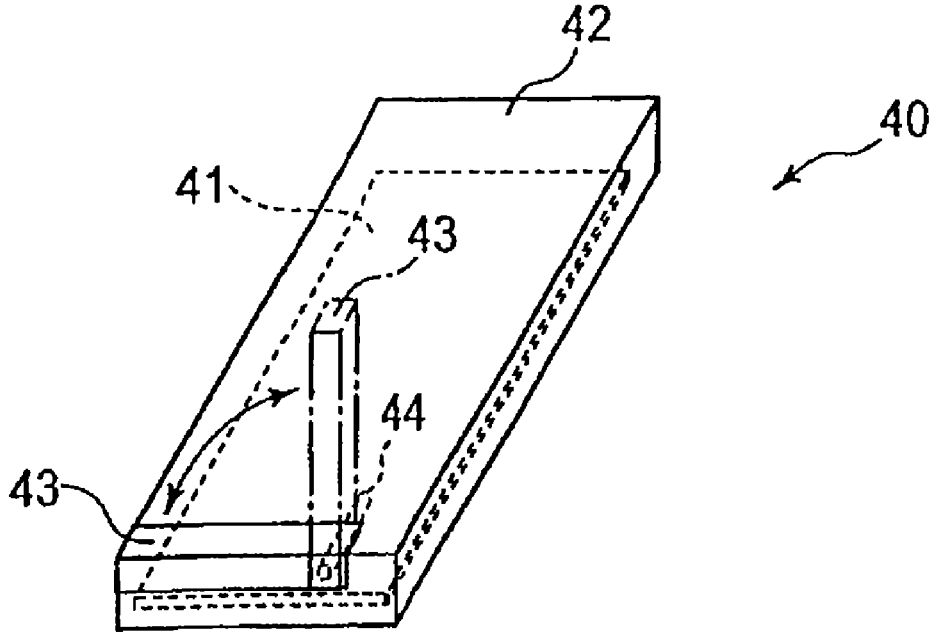
FIG. 12 is a diagram illustrating a card-type device in the related art.

Furthermore, the antenna structure body 3 has been described to be substantially U-shaped. However, the antenna structure body 3 may be of a shape shown by FIG. 11*a* or a shape shown by FIG. 11*b*, and there are no particular limitations to the shape of the antenna structure body 3. Note that in an example of FIG. 11*b*, an antenna structure body 3 has two projecting terminals, and one of the two terminals serves as a feeding terminal corresponding to the feeding terminal 11 described in each of the first and second embodiments, and the other serves as a turning shaft corresponding to the turning shaft 19 described in each of the first and second embodiments. Center axes of the feeding terminal 11 and the turning shaft 19 are arranged in a straight line. In a case where the antenna structure body 3 shown in FIG. 11*b* is employed, an antenna structure support 27 is disposed in the housing 2, for example, in a position indicated by a dotted line. For example, a locking projection corresponding to the locking projection 33 is disposed on a wall from which the feeding terminal 11 projects, and a recess which will receive the locking projection when the antenna structure body 3 is laid flat is made in a wall of the antenna structure support 27 facing the wall from which the feeding terminal 11 projects. The recess may serve as a locking portion when the antenna structure body 3 is laid flat. Specifically, the recess may lock the projection therein so as to stop the antenna structure body 3 from turning toward the upright position urged by the turning spring 25.

Furthermore, according to the first to fourth embodiments, in the first locking mechanism, the locking projection 33 is disposed on the antenna structure body 3 and the recess 32 serving as a locking portion is disposed on the antenna structure support 27 of the housing 2. However, for example, a recess serving as a locking portion may be disposed on the antenna structure body 3, and the locking projection may be disposed on the antenna structure support 27 of the housing 2. Furthermore, in the first to fourth embodiments, the locking projection of the first locking mechanism is fitted to the recessed locking portion. However, the locking portion may be configured as a projection. In addition, in the first to fourth embodiments, the locking projection of the first locking mechanism is disposed on the attachment portion 7 of the antenna structure body 3, and the locking portion of the first locking mechanism is disposed on the portion of the antenna structure support 27 which faces to the attachment portion 7. However, for example, positions of the locking projection and the locking portion of the first locking mechanism for locking the antenna structure body 3 are not limited to the positions described in the first to fourth embodiments, and the locking projection and the locking portion may be positioned, for example, in the vicinity of the second locking mechanism.

Moreover, in the first to fourth embodiments, the locking portion 35 of the second locking mechanism has a projection. However, the locking portion 35 may be configured as a recess. That is, shapes of the locking hook 34 and the locking portion 35 of the second locking mechanism are not limited to particular shapes. According to the first to fourth embodiment, a plurality of locking mechanisms, that is, the first and second locking mechanisms are provided. However, if the antenna structure body 3 can be stably maintained in a locked state using only one of the first and second locking mechanisms, only one locking mechanism may be provided, that is, only one of the first and second locking mechanisms (for example, only the second locking mechanism) may be provided. On the other hand, if it is desired to maintain the antenna structure body 3 in the locked sate more stably, three or more locking mechanisms may be provided.

In the first to fourth embodiments, the inclination control unit is provided for controlling the inclination of the antenna structure body 3 in the standing state. However, in a case where the standing position of the antenna structure body 3 is not variable, for example, in a case where only one position is determined as the upright position of the antenna structure body 3 and a stopper is disposed so as to stop the turning motion of the antenna structure body 3 in the upright position, the inclination control unit of the antenna structure body 3 is not necessary. Furthermore, in the first to fourth embodiments, the maintenance of the antenna structure body 3 in the standing state and the control of the inclination of the antenna structure body 3 in the standing state is performed using the friction generated in the portion in which the O-ring 20 abuts on the wall 8*a* of the attachment portion 8 and in the portion in which the O-ring 20 abuts on the flange portion 19*b* of the turning shaft 19. However, a spring washer or grease may be used in stead of the O-ring 20 for the inclination control unit for controlling the inclination of the antenna structure body 3 in the standing state.

In the first to fourth embodiments, the spring 31 which is a locking elastic member and which urges the antenna structure body 3 in the locking direction along the turning axis is provided.

However, for example, if other means is provided in order to stably maintain a state in which the locking projection is fitted to the locking portion, the spring 31 is not necessary.

In the first to fourth embodiments, the feeding terminal 11 used to electrically connect the antenna body 5 to the circuit of the circuit board included in the housing 2 and the turning shafts 19 and 47 serving as the turning axis of the turning motion of the antenna structure body 3 are provided separately from each other. However, a terminal which functions both as a feeding terminal and as a turning axis may be provided.

INDUSTRIAL APPLICABILITY

The present invention is applicable to a card-type device such as a PC card having a wireless communication function.

The invention claimed is:

1. A card-type device comprising:

a housing;

a circuit board within the housing;

an antenna body disposed outside of the housing;

a turning shaft connected to the housing and configured to allow the antenna body to turn between a first position in which the antenna body stands substantially upright relative to a surface of the housing and a second position in which the antenna body lies substantially flat relative to the surface of the housing;

an antenna turning member configured to apply an urging force to the antenna body in a direction in which the antenna body turns toward the substantially upright position on the turning shaft;

a locking mechanism that includes a locking projection positioned on one of the antenna body and the housing, and a corresponding locking portion positioned on the other of the antenna body and the housing, the locking portion being fitted to the locking projection when the antenna body is in the second position and which stops the antenna body from turning in a direction toward the first position due to the urging force applied by the antenna turning member; and a locking elastic member configured to apply an urging force to the antenna body in a locking direction along the turning shaft;

wherein in a state in which the locking projection is fitted to the locking portion, when the antenna body moves along the turning shaft in an unlocking direction, the locking projection is released from the locking portion, and the antenna body turns in the direction toward the first position.

2. The card-type device according to claim 1, further comprising:

an inclination control unit configured to vary an inclination of the antenna body.

3. The card-type device according to claim 2, wherein the inclination control unit includes a plurality of recesses positioned on one of the antenna body and the housing, the plurality of recesses cooperating with the locking projection to vary the inclination of the antenna body in a step-by-step manner.

4. The card-type device according to claim 1, further comprising:

a plurality of locking mechanisms.

5. A card-type device comprising:

a housing;

a circuit board within the housing;

an antenna body disposed outside of the housing;

a turning shaft connected to the housing and configured to allow the antenna body to turn between a first position in which the antenna body stands substantially upright relative to a surface of the housing and a second position in which the antenna body lies substantially flat relative to the surface of the housing;

an antenna turning member configured to apply an urging force to the antenna body in a direction in which the antenna body turns toward the substantially upright position on the turning shaft;

a locking mechanism that includes a locking projection positioned on one of the antenna body and the housing, and a corresponding locking portion positioned on the other of the antenna body and the housing, the locking portion being fitted to the locking projection when the antenna body is in the second position and which stops the antenna body from turning in a direction toward the first position due to the urging force applied by the antenna turning member, wherein in a state in which the locking projection is fitted to the locking portion, when the antenna body moves along the turning shaft in an unlocking direction, the locking projection is released from the locking portion, and the antenna body turns in the direction toward the first position; and a damper that reduces a turning speed of the antenna body, the damper being positioned in a portion in which the antenna body and the housing rub against each other when the antenna body turns on the turning shaft relative to the housing.

6. The card-type device according to claim 5, further comprising:

a turning mechanism unit including a unit case having an open side, the turning shaft having a first end thereof rotatably fitted in the unit case and having a second end thereof projecting outward from the open side, the unit case being inserted and fixed in the antenna body, the second end of the turning shaft projecting outward from the antenna structure body and non-rotatably supported by the housing, the antenna body turning on the turning shaft supported by the housing, wherein the damper is positioned between the unit case of the turning mechanism unit and the first end of the turning shaft fitted in the unit case.

* * * * *

UNITED STATES PATENT AND TRADEMARK OFFICE

CERTIFICATE OF CORRECTION

PATENT NO. : 8,040,282 B2
APPLICATION NO. : 12/119687
DATED : October 18, 2011
INVENTOR(S) : Masanori Tsubono et al.

It is certified that error appears in the above-identified patent and that said Letters Patent is hereby corrected as shown below:

Title page under item (30), Foreign Application Priority Data, please delete:

"Nov. 15, 2006 (WO).....PCT/JP2006/322758" and add new section

-- Related U.S. Application Data

(63) Continuation of application No. PCT/JP2006/322758, filed on Nov. 15, 2006 --

Signed and Sealed this
Twenty-first Day of February, 2012

David J. Kappos

David J. Kappos
*Director of the United States Patent and Trademark Office*